United States Patent [19]

Stubbs et al.

[11] Patent Number: 4,534,296

[45] Date of Patent: Aug. 13, 1985

[54] RAIL GAUGER

[75] Inventors: John L. Stubbs, Charlotte; Carl B. Loflin, Denver, both of N.C.

[73] Assignee: Southern Railway Company, Washington, D.C.

[21] Appl. No.: 490,025

[22] Filed: Apr. 29, 1983

[51] Int. Cl.[3] ..... E01B 33/00; E01B 33/02

[52] U.S. Cl. ..... 104/8; 104/2; 104/17 R

[58] Field of Search ..... 104/2, 8, 16, 17 R; 33/1 Q, 338; 254/43

[56] References Cited

U.S. PATENT DOCUMENTS

| | | | |
|---|---|---|---|
| 651,519 | 6/1900 | Algoud . | |
| 993,869 | 5/1911 | Peasley . | |
| 1,136,427 | 4/1915 | Lakhovsky . | |
| 1,321,909 | 11/1919 | Hastings . | |
| 2,135,087 | 11/1938 | Mathias . | |
| 3,073,258 | 1/1963 | Miller | 104/8 |
| 3,330,219 | 7/1967 | Plasser et al. . | |
| 3,465,687 | 9/1969 | Kerns . | |
| 3,500,762 | 3/1970 | Plasser | 104/8 |
| 3,524,624 | 8/1970 | Blackwell | 254/43 |
| 3,552,320 | 1/1971 | Traupmann . | |
| 3,699,894 | 10/1972 | Plasser et al. . | |
| 3,795,056 | 3/1974 | Plasser et al. . | |
| 3,952,665 | 4/1976 | Stewart et al. . | |
| 3,972,292 | 8/1976 | Theurer . | |
| 4,109,388 | 8/1978 | Stewart . | |
| 4,127,069 | 11/1978 | Stewart et al. . | |
| 4,301,738 | 11/1981 | Theurer . | |

FOREIGN PATENT DOCUMENTS

| | | | |
|---|---|---|---|
| 0519453 | 5/1929 | Fed. Rep. of Germany | 104/8 |
| 0608788 | 1/1935 | Fed. Rep. of Germany | 104/8 |

*Primary Examiner*—Randolph A. Reese
*Assistant Examiner*—Dennis Rodgers
*Attorney, Agent, or Firm*—Watson, Cole, Grindle & Watson

[57] ABSTRACT

A track gauger includes a vertically movable gauger frame having a pair of fixed rail gauge bars extending between the rails upon a lowering of the frame. The gauger frame lies crosswise relative to the frame of a rail vehicle on which it is mounted, and outer edges of the bars are spaced apart in this crosswise direction a fixed distance for establishing a predetermined rail gauge distance. Pivotable rail gauge levers on the gauger frame engage the rails for gauging them at such predetermined distance upon engagement between the rails and the outer edges of the gauge bars. A track pre-gauger is mounted on the front end of the vehicle frame for pre-gauging the rails at such predetermined rail gauge distance.

4 Claims, 6 Drawing Figures

52
53
43
67
65
71
74
42
48
73
56
57
58
55
16
68
6
63
61
46
44
49
41
17
45
54
69
59
62
11
72
15
66
64

RAIL GAUGER

BACKGROUND OF THE INVENTION

This invention relates generally to a rail gauging apparatus mounted on a vehicle adapted for movements along the rails of a track, and more particularly to such an apparatus which has a vertically movable frame on which rail gauge bars are mounted for accurately gauging the track as rail gauge levers on the frame engage the rails together with the bars. And, a pre-gauger is mounted on the front end of the vehicle for roughly gauging the rails.

Track gaugers of different varieties have been in use for a number of years, many of which are manually operated, and some of which comprise flanged rollers or the like mounted at the front end of a rail vehicle. Such gaugers normally engage the rail heads, and others have been developed for engaging the rail webs for shifting one or both rails during a rail laying or rail renewing operation. The principle drawback to the use of these gaugers is their inherent gauging inaccuracy, not to mention the obvious disadvantages in utilizing manual gaugers. By engaging the rail heads or webs, the rails oftentimes tend to topple instead of being shifted at their base to the necessary extent. This leads to gauging inaccuracy which presents special problems at track elevations and track curves and especially at track curved elevations.

In U.S. Pat. No. 3,552,320, a track gauger utilized with a spike driving device engages the rail base during a rail gauging operation. The gauger is mounted on a rail vehicle and includes rail engaging blade pairs. The blades of each pair are pivotally mounted on a common axes and are interconnected via a linkage arrangement. One of the blades is pivoted by a hydraulic cylinder unit, and its associated blade is pivoted via the linkage arrangement. Clamping blocks at the ends of the blades of one of the blade pairs engage a free or loose rail while the clamping blocks on the blades of the other pair engage a fixed rail, whereupon the loose rail may be shifted relative to the fixed rail to the proper gauge. However, because of the rather complex linkage arrangement between the blades at each pair, accurate rail gauging is difficult to achieve. Worn linkage elements require constant adjustment after even short periods of use, and the operational speed of the gauger is limited. These and other disadvantages are avoided by the present invention which constitutes an improvement over this known rail base gauger.

SUMMARY OF THE INVENTION

It is therefore an object of the present invention to provide an improved rail base gauger mounted on a rail vehicle and having a minimum of movable parts yet capable of accurately gauging the rails of a railway track, in a simple yet highly efficient manner, in readiness for a rail spiking operation during track laying or track renewing.

Another object of this invention is to provide such a track gauger which includes a vertically movable frame having a pair of fixed rail gauge bars with the outer edges confronting the rails being relatively spaced apart a fixed distance for establishing a predetermined rail gauge distance. Upon a lowering of the frame, the gauge bars extend between the rails, and a pair of rail gauge levers pivotally mounted on the frame are swung into engagement with the rails for gauging them at such predetermined rail gauge distance upon engagement between the outer edges of the gauge bars and the rails.

A further object of this invention is to provide such a track gauger wherein the gauger frame includes stops for limiting the lowered extent of the frame upon engagement with the top surfaces of the rail heads.

A still further object of the present invention is to provide such a track gauger wherein the stops are spaced inwardly of the lower edge of the frame, substantially U-shaped cutouts in the frame extending inwardly of such lower edge and including the stops at the base thereof, the rails being received in such cutouts at the lowered extent of the frame.

A still further object of the present invention is to provide such a track gauger wherein a pre-gauging device is mounted at the front end of the vehicle relative to the direction of travel thereof along the rails, rail gauge rollers on the device extending between the rails and establishing the predetermined rail gauge distance. Rail gauge rollers on the device are inwardly shiftable against the outer surfaces of the rail heads for clamping the rails together with the gauge rollers.

A still further object of this invention is to provide such a track gauger wherein a limit switch is provided on the gauger frame for actuating the shifting of the rail guide rollers as the limit switch is tripped upon inward pivotal movement of one of the rail gauge levers.

Other objects, advantages and novel features of this invention will become more apparent from the following detailed description of the invention when taken in conjunction with the accompanying drawings.

DETAILED DESCRIPTION OF THE INVENTION

Figure 1:
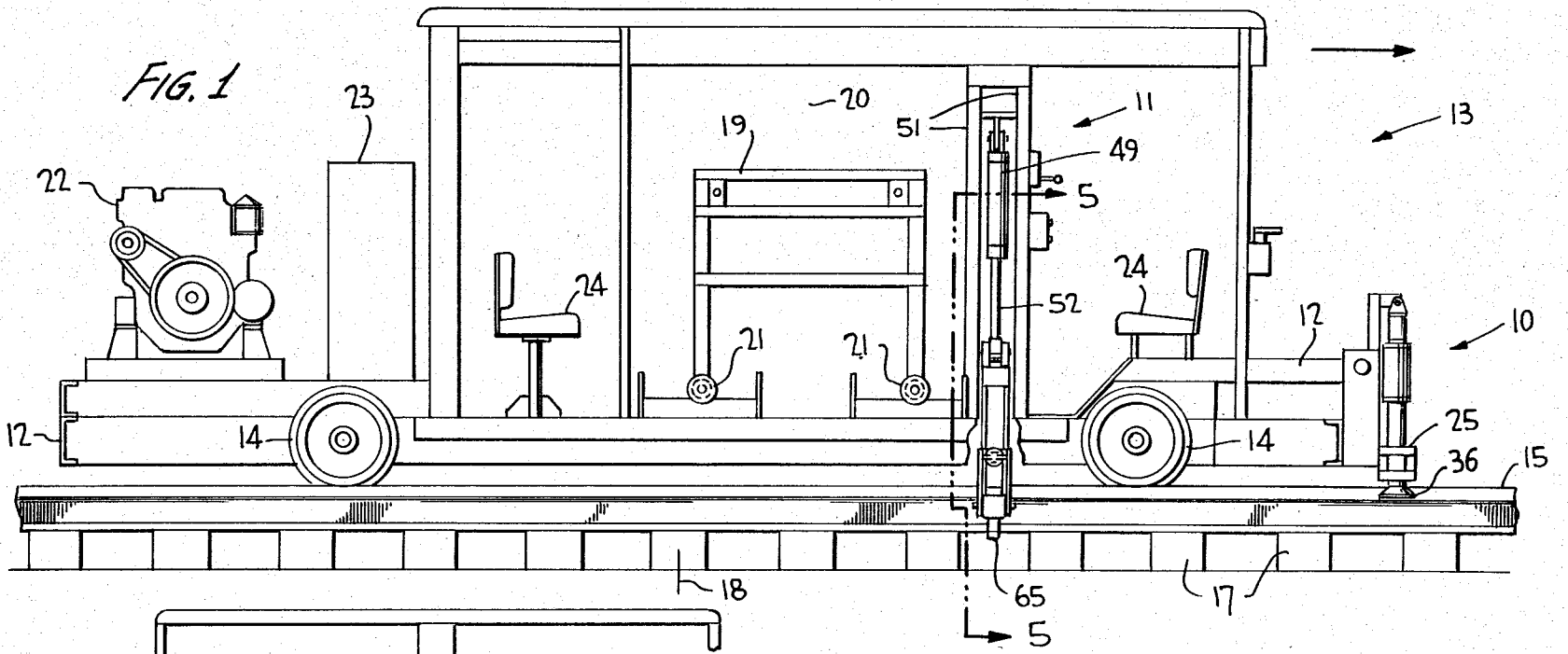
FIG. 1 is a side elevational view of a rail vehicle supporting the track gauger and track pre-gauger according to the invention.

Turning now to the drawings wherein like reference characters refer to like and corresponding parts throughout the several views, a track pre-gauger 10 and a track gauger 11 of the invention are mounted on frame 12 of a rail vehicle 13 which is carried by rail engaging wheels 14 on rails 15, 16 supported on spaced crossties 17. As will be described in more detail hereinafter, the track pre-gauger functions to pre-gauge the rails laid on the track at a narrow gauge, and a precise rail gauging operation is carried out by the track gauger.

Prior to track gauging, rails 15 and 16 are laid on the crossties with the use of some suitable rail laying equipment. A stripe is painted on the crossties at the centerline of the track, and one of the rails such as 15 is partially spiked to the ties at a suitable distance from the stripe depending on the weight of the rail.

It should be pointed out that both rails are completely spiked up through location 18 by means of a spike driving device (not shown) mounted on the vehicle frame overlying the rails. The spike driver is mounted at location 20 on a movable carriage 19 having rollers 21 to facilitate fore-and-aft carriage travel to some slight extent. The vehicle includes its own power supply as shown by a diesel engine 22, and has mounted on its frame fuel and hydraulic oil tanks 23. Facing operator's seats 24 may likewise be mounted on the vehicle frame.

Figure 2:
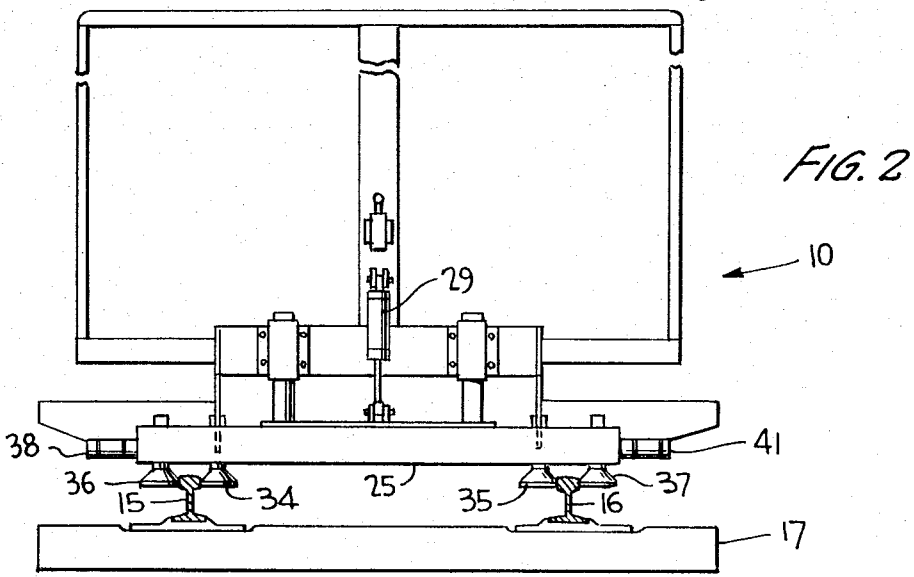
FIG. 2 is a front elevational view of the track pre-gauger.
Figure 3:
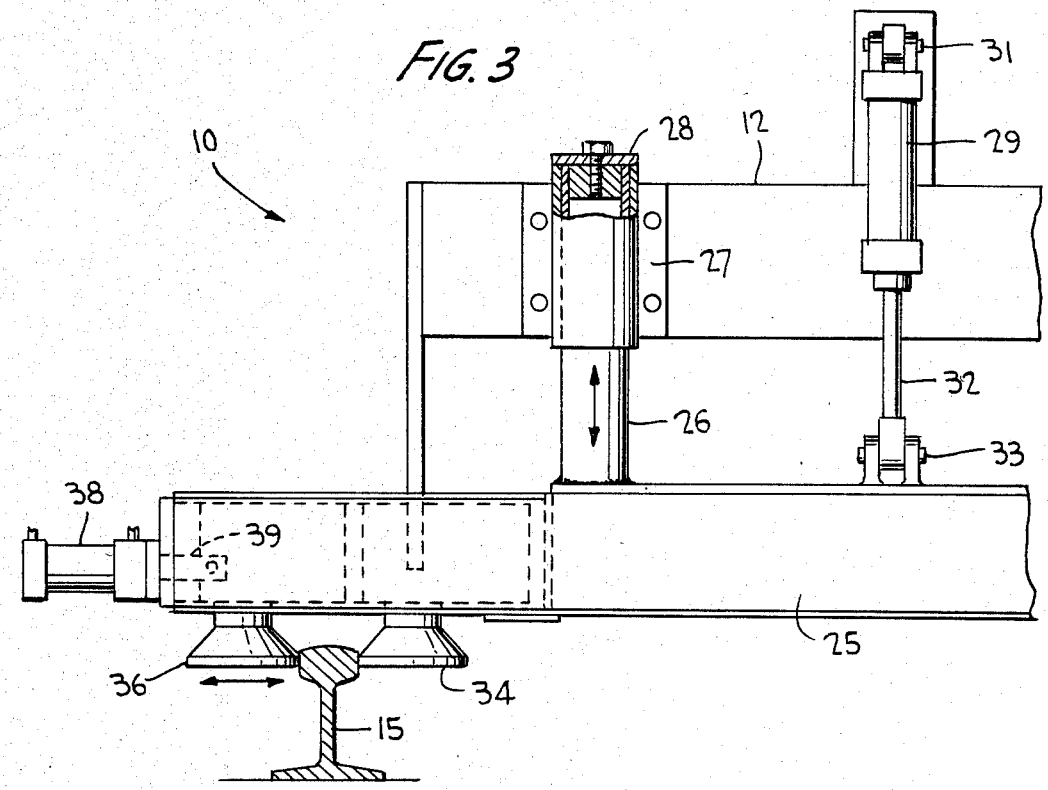
FIG. 3 is a view similar to FIG. 2, at an enlarged scale, of part of the track pre-gauger.
Figure 4:
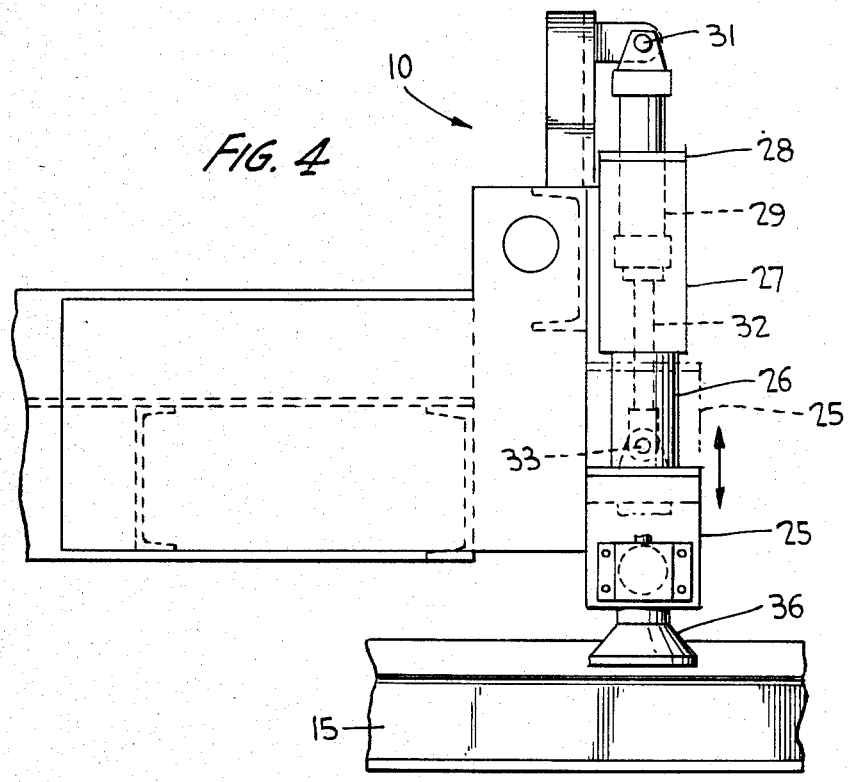
FIG. 4 is a side elevational view, at an enlarged scale, of the track pre-gauger.

Turning to FIGS. 2, 3 and 4, track pre-gauger 10 comprises a transverse pre-gauger frame 25 which has upstanding cylindrical bars 26 thereon extending through hat-shaped bar guides 27 securely fixed to the front end of vehicle frame 12. Caps 28 secured to the bars abut against the upper edges of guides 27 at the lowermost position of frame 25 shown in FIGS. 2 and 3. A hydraulic unit has its cylinder 29 clevis mounted as at 31 to the front end of the vehicle frame, and its piston 32 affixed to pre-gauger frame 25 as at 33. Thus, the pre-gauger frame may be raised and lowered in the direction of the double arrow of FIG. 3. The frame is raised to its phantom outline position of FIG. 4 during periods of storage and non-use.

A pair of rail gauge rollers 34, 35 are mounted on the underside of frame 25 and extend between the rail heads in the lowered position of FIG. 3. These rollers are mounted for rotation about their axes which are fixed at such a distance apart for setting the rollers, as measured between points of contact with the rails, to a standard rail gauge which, for example, is 56½ inches for a 132 pound rail between rail head faces. These rail gauge rollers define inner rail bearing elements which may be non-rotatable, although rollers such as 34 and 35 are preferred for avoiding frictional wear upon rotation when in bearing engagement with the rail heads during forward travel of the vehicle. And, it should be observed that, although the rail gauge rollers are set to the aforementioned standard rail gauge, a precise setting by the pre-gauger to this gauge is not made due to the engagement between the gauge rollers and the rail heads, for the reasons mentioned above when describing the prior art.

Rail guide rollers 36, 37 are mounted outwardly of rollers 34, 35 on the underside of frame 25 and are of the same extent as the rail gauge rollers. These rollers 36 and 37 are likewise mounted for rotation about their central axes but are capable of being laterally shifted as shown by the double arrow in FIG. 3. A hydraulic unit 38 is mounted on frame 25 and has its piston 39 attached to the axle (not shown) on which roller 36 is rotatably mounted, to thereby effect lateral shifting of the roller upon operation of the unit. Another hydraulic unit 41 is associated with roller 37 in an identical manner and functions the same for shifting that roller inwardly and outwardly relative to rail 16.

Track gauger 11 has a gauger frame comprising a pair of spaced hat-shaped plates 42, 43 (FIGS. 5 and 6) having bearing rollers 44 mounted adjacent inner edges 45, 46 thereof. In the lowermost position of the gauger frame shown in FIG. 5, upper inner edges 47 of the frame plates bear against the upper surface of a center sill 48 of the vehicle frame, and upper pairs of opposing rollers 44 engage opposing sides of the center sill which are covered with wear resistant material of some suitable type. A hydraulic unit has its cylinder 49 affixed to upstanding supports 51 mounted on the vehicle frame, and its piston 52 clevis mounted as at 53 to plates 42, 43. Thus, the track gauger frame may be raised and lowered between its solid and phantom outline positions of FIG. 5. When in its raised position, the lower pairs of opposing rollers 44 engage the opposing sides of the center sill to thereby function, together with the remaining rollers 44, as friction bearings.

Figures 5, 6:
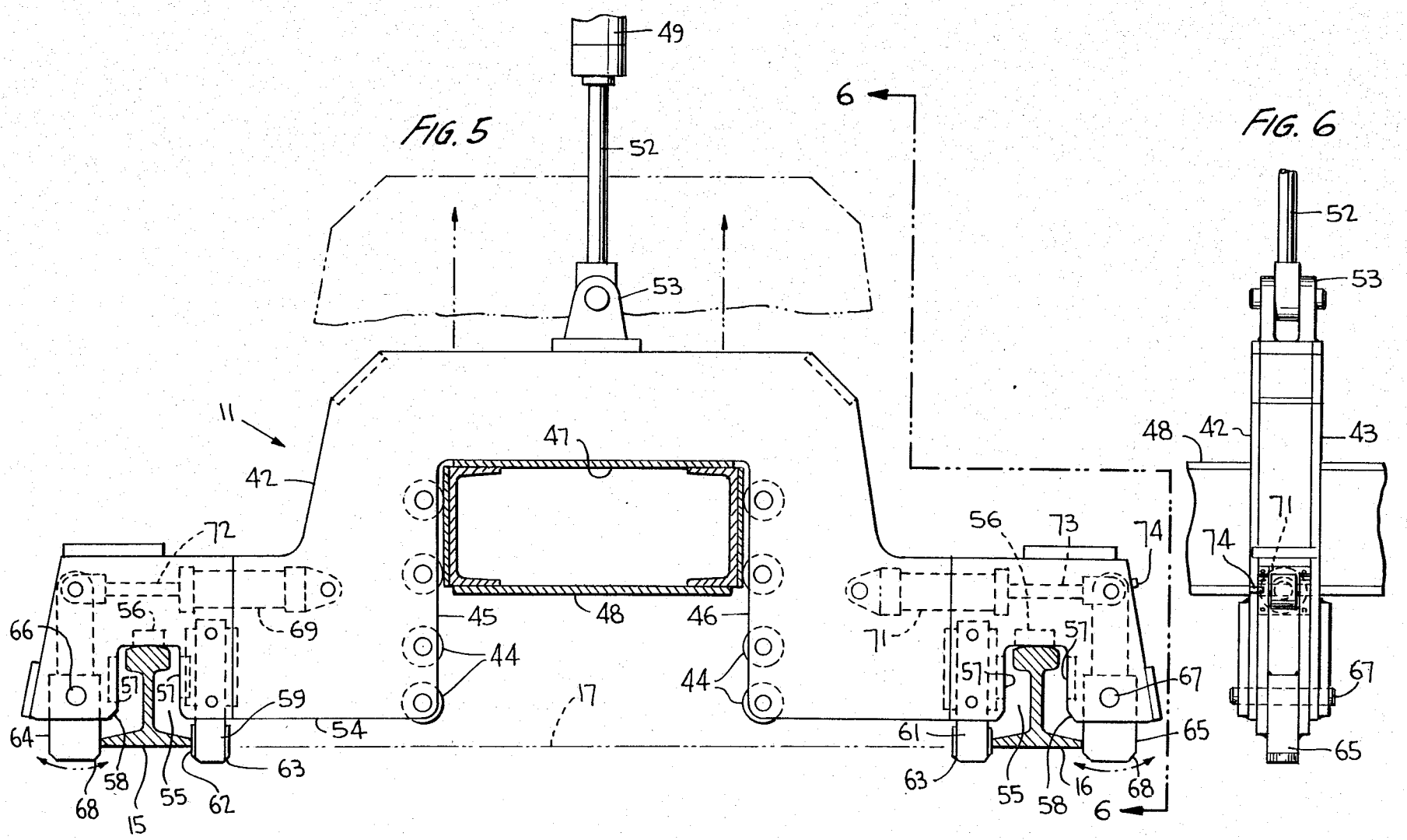
FIG. 5 is a side elevational view of the track gauger, taken substantially along the line 5—5 of FIG. 1.
FIG. 6 is an end elevational view of the track gauger taken substantially along the line 6—6 of FIG. 5.

Extending inwardly a bottom edge 54 of each plate 42, 43, is a substantially U-shaped cutout 55 adjacent opposing ends of the plates. A stop element 56 of hardened material is secured between the plates at the base of each of the opposing cutouts. The stops against the top surfaces of the rail heads for limiting the lowered extent of the gauger frame as shown in FIG. 5. And, bars 57 of hard material of some type are sandwiched between plates 42, 43 at the opposing sides of the cutouts for protecting the gauger frame in the event of impact against the rails. Furthermore, the open ends of the cutouts diverge outwardly as at 58 for guiding the gauger frame along the top sides of the rails in the event of any impact therewith when being lowered. And, it can be seen that, other than the rail base flanges, the rails are received within the opposing cutouts in the lowered position of the frame.

Rail gauge bars 59, 61 are mounted to the gauger frame between plates 42, 43 and extend downwardly from bottom edge 54 between the rail base flanges in the lowermost position of the gauger frame of FIG. 5. These rail gauge bars are fixedly mounted in place, and the distance between the outer edges 62 of the bars is fixed and establishes the predetermined rail gauge distance between inner edges of the rail base flanges which for example, is 53 and 13/16 inches for 132 pound rails. This gauge distance will, of course, vary for differently sized rails. And, these outer edges 62 may be covered with a suitable hardened material for protecting the rail gauge bars when contacting the rails. The opposing inner edges of the bars may be similarly protected since the bars may be dismantled and again remounted in place, with these inner edges outermost, in the event of undue wear of the rail gauge bars after repeated use. Moreover, the free ends of the bars are chamfered on both sides as at 63 for guiding the bars, if necessary, along the inner base flange edges of the rails upon a lowering of the gauger frame.

Rail gauge levers 64, 65 are respectively spaced outwardly of guide bars 59, 61 and are mounted on the gauger frame between plates 42, 43 for movement about pivot axes 66 and 67, respectively. The edges of these levers confronting the rails, as well as the opposing edges, may be covered with some suitable hard material for protecting the levers against undue wear, and the free ends of the levers are chamfered as at 68 in the event the levers need to be guided along the edges of the rail base flanges during a lowering of the gauger frame. As with the rail gauge bars, the rail gauge levers may be dismantled and remounted in place so that their inner edges face outwardly, in the event the levers become unduly worn after repeated use.

The levers are pivotable about their axes, in the directions of their double arrows shown in FIG. 5, by the provision of hydraulic units having their cylinders 69, 71 mounted on the gauger frame between plates 42, 43, with their pistons 72, 73 clevis connected to the upper ends of the rail gauge levers.

In operation, the track gauger frame is elevated to its phantom outline position of FIG. 5 such that the rail gauge bars lie above the rail base flanges, and the rail gauge levers are pivoted outwardly away from the rails by operation of their hydraulic units. On the other hand, frame 25 of the track pre-gauger is lowered into its position of FIGS. 2 and 3 with its rail guide rollers shifted outwardly away from the rails. Assuming rail 15 to be fixed in place on the crossties (normally partially spiked), roller 34 is in rolling contact with the inner face of the rail ball or head of rail 15 and is rotated about its central axis as vehicle 13 travels forward along the rails (shown by the arrow in FIG. 1) to the position shown in this Figure from a location upstream thereof. During such vehicle travel, rail gauge roller 35 will engage the inner rail head face of rail 16 if this rail 16 has been laid on the track at a narrow gauge. Otherwise, if rail 16 lies on the track at a wide gauge, roller 35 will be out of contact therewith. Assuming a narrow gauge condition, which is usually the case, the pre-gauger will shift loose rail 16 outwardly relative to fixed rail 13 during vehicle travel. And, assuming that both rails have been completely spiked at location 18 and upstream thereof, the vehicle stops at the FIG. 1 position, and the track gauger frame 42, 43 is lowered to its solid outline position of FIG. 5 such that rail gauge bars 59, 61 extend between the base flanges of the rails. Depending on the rail gauge at the location of the track gauger, bars 59, 61 may both be out of contact with the rail at the lowered position of the track gauger frame, may both be in contact with the rail base flanges in this position, or either one may only be in contact with its associated rail base. With rail 15 at least partially fixed in place, bar 59 will likely be in at least light contact with inner edge of its rail base at the lowermost extent of the track gauger frame. Rail gauge levers 64 and 65 are then pivoted inwardly against rails 15 and 16 for setting the rails at the appropriate rail gauge as the rails are pressed against edges 62 of the rail gauge bars. When lever 64 engages the base of rail 15, the rail will be firmly clamped between bar 59 and this lever. And, when lever 65 is pivoted into contact with the base flange of rail 16, it will shift this rail along the base firmly into contact with bar 63, assuming that the loose rail is at a wide gauge and needs to be inwardly shifted into its proper gauge. In any event, if rail 16 is at a slightly narrow gauge at the track gauger location, it will have been shifted outwardly into its appropriate gauge by bar 61, whereafter lever 65 firmly clamps the rail. It should be pointed out that the rails at the position of the track gauger are not likely to be out of gauge to a great extent since they are already spiked at location 18. And, when rail gauge levers 64, 65 are pivoted inwardly against the rails, a limit switch 74 on the track gauger frame, which extends into the path of pivoting lever 65, is tripped by lever 65 and functions to actuate hydraulic units 38, 41 for shifting rail guide rollers 36, 37 inwardly against the rail heads. Thus, in a wide gauge condition of the rails downstream of the pre-gauger, lever 65 and roller 37 will inwardly shift rail 16 into its predetermined rail gauge position, as rail guide rollers 36 and 37 are shifted inwardly to clamp the rail heads together with rail gauge rollers 34, 35. Thus, the rails are securely clamped at the track gauger and the track pre-gauger locations after which the rail spiking operation is carried out at location 20. A precise rail gauging/spiking procedure is therefore capable of being carried out. And, engagement of the rails by rollers 34, 36 and 35, 37, and engagement of the rails by the bars and levers of the track gauger, provide spaced rail holding points during the spike driving operation.

Thereafter, hydraulic cylinders 69 and 71 are actuated for pivoting rail gauge levers 64 and 65 away from the rails and for again tripping the limit switch which effects operation of hydraulic units 38 and 41 for shifting rail guide rollers 36 and 37 outwardly away from the rails. The vehicle then travels forwardly, stops, and the track gauger frame is lowered into its FIG. 5 position between the next adjacent pair of crossties, after which the aforedescribed operation is repeated. Carriage 19, which supports the spiked driver, is capable of shifting slightly in a fore-and-aft direction for spiking the rails to a single crosstie. However, the carriage could be mounted on the vehicle frame at a greater distance from track gauge 11, and may be provided a greater range of travel in the fore-and-aft direction so as to carry out the spiking operation relative to more than one crosstie. Upon completion of the track gauging/-spiking operation, the frames of both the track pre-gauger and the track gauger are elevated and the vehicle is moved to storage or to some other desired location.

It should be pointed out that, although the gauging/-spiking operation has been described above relative to a partially fixed rail 13, the invention may likewise be carried out for rails which are both free or loose. Thus, one or both rails 15, 16 will be shifted outwardly upon engagement by rollers 34, 35 of the track pre-gauger in the event the rails are laid on the track at a narrow gauge downstream of vehicle 10. Otherwise, when laid at a wide gauge, one or both rails will be shifted inwardly relative to one another as rail gauge levers 64 and 65 of the track gauger and as roller 36 and 37 of the track pre-gauger are pivoted inwardly, whereupon the rails are clamped between the roller pairs 36, 34 and 35, 37 of the track pre-gauger as in the manner aforedescribed.

Obviously, many other modifications and variations of the present invention are made possible in the light of the above teachings. It is therefore to be understood that within the scope of the appended claims the invention may be practiced otherwise than as specifically described.

What is claimed is:

1. A track gauger on the frame of a vehicle adapted for movement along the rails of a track, the gauger comprising a vertically movable gauger frame disposed crosswise of said vehicle frame, a pair of gauger bars fixedly mounted on said gauger frame and having outer edges spaced apart in crosswise direction of a fixed distance for establishing a predetermined rail gauge distance, means for lowering said frame for extending said gauge bars between the rails, a pair of gauge levers mounted for movement on said gauger frame about pivot axes spaced respectively outwardly of said bars, means for pivoting said levers into engagement with the rails for gauging the rails at said predetermined distance upon engagement between the rails and said outer edges of said gauge bar, a track pre-gauger having a frame lying in said crosswise direction and being mounted on a front end of said vehicle frame relative to a forward direction of travel along the rails, inner bearing elements mounted on said pre-gauger frame and extending between the rails, said inner bearing elements having bearing surfaces spaced apart a fixed distance for establishing said predetermined rail gauge distance, outer bearing elements mounted on said pre-gauger frame outwardly of said inner elements and being inwardly shiftable relative thereto, means for shifting said outer elements into engagement with the rails for gauging the rails at said predetermined distance upon engagement between the rails and said bearing surfaces of said inner elements, a spike driving device mounted on said vehicle frame rearwardly of said track gauger frame, limit switch means on said gauger frame for actuating said shifting means, said limit switch means being operated by one of said rail gauge levers upon the pivoting of said levers into engagement with the rails, whereby engagement of the rails by said gauge bars and levers, and by said bearing elements, provide spaced rail holding points during a spike driving operation.

2. The gauger according to claim 1, wherein said frame includes stop means engageable with the top surfaces of the rail heads for limiting the lowered extent of said gauger frame.

3. The gauger according to claim 2, wherein said stop means are spaced upwardly of a lower edge of said gauger frame, substantially U-shaped cutouts in said gauger frame extending upwardly of said lower edge and including said stop means at the base thereof, the rails being received in said cutouts at said lowered extent of said gauger frame.

4. The gauger according to claim 1, wherein said inner and outer bearing elements comprise rollers rotatably mounted on said pre-gauger frame and being rotated during travel of the apparatus upon engagement with the rails.

* * * * *